United States Patent [19]

Warren

[11] 4,395,964

[45] Aug. 2, 1983

[54] METHOD OF MAKING PATCHWORK ARTICLES

[76] Inventor: Marjory A. Warren, 1641 Third Ave., Apt. 31A, New York, N.Y. 10028

[21] Appl. No.: 271,421

[22] Filed: Jun. 8, 1981

[51] Int. Cl.[3] ..... D05B 97/00

[52] U.S. Cl. ..... 112/262.1; 2/243 R; 2/243 B; 112/441

[58] Field of Search ..... 112/262.1, 440, 441, 112/1; 2/243 R, 243 B; 28/163

[56] References Cited

U.S. PATENT DOCUMENTS

| | | | |
|---|---|---|---|
| 327,961 | 10/1885 | Moschcowitz | 2/243 B X |
| 2,131,390 | 9/1938 | Rosenfeld | 2/243 B |
| 2,892,196 | 6/1959 | Pandyk et al. | 2/243 R |
| 3,226,732 | 1/1966 | Zerilli | 2/243 R X |
| 3,325,826 | 6/1967 | Ryan | 2/243 R |
| 3,406,407 | 10/1968 | Parlanti | 2/243 R |
| 3,898,943 | 8/1975 | Braden et al. | 112/262.1 |

*Primary Examiner*—H. Hampton Hunter

*Attorney, Agent, or Firm*—Eliot S. Gerber

[57] ABSTRACT

A method of making patchwork articles includes the steps of drawing the overall pattern of the patchwork article onto a sheet of paper to produce a master drawing which is an overall pattern of visible lines. The master drawing is then reproduced on flexible paper, preferably tracing paper, which is then cut along the visible lines to form individual paper patterns. Each of the paper patterns is used as a guide for cutting a fabric piece which is of the same general shape as the paper pattern but slightly enlarged on all sides to form a border. The borders of each fabric piece are folded over the paper pattern from which the piece was cut and the borders are held to the paper pattern by temporary stitching. The individual fabric pieces are then joined together using the numbers or other indicia on the paper patterns as a guide, so that the joining of the fabric pieces corresponds in overall design to the original overall design as drawn on the paper. The temporary stitches and the paper patterns are then removed from the patchwork article.

3 Claims, 4 Drawing Figures

METHOD OF MAKING PATCHWORK ARTICLES

BACKGROUND OF THE INVENTION

The present invention relates to methods of producing patterns from textile fabric and more particularly to methods of producing patchwork patterns from textile fabric.

The art and craft of patchwork has been known for hundreds of years and many beautiful examples of patchwork quilts, patchwork wall hangings and other patchwork articles have been displayed and collected by museums and private collectors. In general, a patchwork article is formed by joining together individual pieces of textile fabric. The textile fabric may be woven or non-woven and may consist of natural fibers such as cotton, wool and linen, and artificial fibers such as nylon, polyester and rayon, as well as blends and mixtures of such fibers. Each piece of textile fabric is a closed geometric shape, for example, a triangle, square or hexagon, with extra material surrounding the geometric shape and forming the border. The pieces are then sewn, or otherwise joined together, to form the overall patchwork article.

There may be said to be two widely used methods of making patchwork, which have been termed the "American" and the "British" methods. For the British method, as explained in the book entitled *Your Book of Patchwork* by Priscilla Lobley, Taplinger Publishing Company, New York, 1974, a set of templets are obtained. The templets are usually manufactured in aluminum alloy or plastic. Each geometric shape (closed geometric figure) and each size requires two templets which correspond to the geometric shape. The inner templet delineates the portion of the fabric piece which will show in the final article and a slightly larger templet of the same shape is used to delineate the borders, although some may use only the inner (smaller) templet and estimate the borders by eye. The smaller templet for each geometric shape is placed on a suitable paper, a flexible paper such as used in magazines, and the required number of the geometric shapes are traced onto paper sheets using the outer edge of the templet. The templet is randomly placed on the paper. For example, if the overall pattern is to be one hundred hexagons, all of the same size, then one may use a single templet to form traced hexagons. Next, the paper is cut using scissors or a sharp razor to form individual paper patterns. Then the larger rigid templets are placed on the textile pieces and either traced onto the pieces using a pencil or alternatively used as a guide to directly cut the fabric with scissors. In either case, a fabric piece having the general geometric shape of the paper is formed, but larger than its paper pattern, since it has a border on all sides. Each fabric piece is then placed on a paper pattern and its borders folded onto the back of the paper and held in place by temporary stitching. Pins or other fasteners may be used to position the paper pattern on the fabric before the temporary stitching is added. One now has a large number of individual patchwork pieces, each of which has the shape it will have in the final overall patchwork pattern and each of which is formed about an individual paper pattern. The individual textile pieces are then joined, preferably by sewing close to their edges, to form a continuous and interlocking overall patchwork pattern. After part, or all, of the patchwork pattern is formed, the temporary stitching is removed from the paper patterns and the paper patterns are pulled out from the individual patchwork pieces.

The "British method" has been successfully used for many years and provides an accurate overall pattern of the tracing from the templets and the cutting out of the individual paper patterns are done with accuracy. That method is generally used along with overall patterns printed in books, which provide the overall pattern for a square or a number of squares and may indicate the general color that should be used for each of the fabric pieces. Priscilla Lobley's book, mentioned above, for example, gives a number of examples of different overall patterns which may be formed using equally sized hexagons, the differences in the overall patterns being in the arrangement of the colors so that each overall pattern has a different appearance depending upon the systematic use of different colored fabrics.

An alternative method of forming patchwork is the so-called "American method", which has been used for many years in the United States to form quilts and other patchwork articles. For example, this method is set forth in the book 101 *Patchwork Patterns* by Ruby McKim, Dover Publishing Company, 1961. The American method also uses templets, with one templet being required for each size and shape of the closed geometric figure to be formed. The templets are generally of aluminum or plastic, although home-made templets made from a stiff cardboard or other stiff material may be used. Each of the templets is the exact size of the patchwork piece which is visible on the surface, i.e., without the border. The patchwork pieces are cut by placing a templet on the fabric and outlining the desired shape using a soft pencil or other marking device. The border is not formed using a templet but is judged by eye, that is, one cuts the fabric piece so that there is a quarter of an inch border outside of the geometric figure and completely encircling it. The individual fabric pieces are then sewn together, taking special care that the points meet. The sewing may be done either by hand or by machine, depending upon the intricacy and size of the pieces to be joined. The McKim book is very explicit in stating that the templets should not be made of paper, but rather of cardboard, metal or clear plastic, and that they must be exact in order to obtain an accurate overall pattern. As in the British method, the individual who sews the pieces together generally follows an overall pattern set forth in a book.

The American method, as described above, may be thought to be more simple than the British method in that it does not require an intermediate step of sewing each individual fabric piece to a paper pattern using temporary stitches and the subsequent removal of the temporary stitches and the paper patterns. However, many craftspeople who have experimented with both methods feel that the British method permits a more accurate registration of the individual fabric pieces and is more likely to result in an accurate overall pattern.

It is possible, using either the British or the American method, for the craftsman to personally design the patchwork pattern. Usually such designs may take the form of sketches or other designs on paper which are similar to the patterns found in books. The designer may design one square of the patchwork overall pattern or may even sketch out the entire quilt or other articles. In both the American and British methods, as decribed above, there is no attempt made to assign each fabric piece to a predetermined position in the overall design. Instead, one cuts the number of each size and shape and color desired and uses them in random. For example, one may cut 50 triangular fabric pieces in red and use them interchangeably when a red triangular piece is needed in executing the overall design.

OBJECTIVES AND FEATURES OF THE INVENTION

It is an objective of the present invention to provide an improved method of making patchwork articles from pieces of textile fabric in which each piece of such fabric will exactly and accurately fit the proximate piece to which it is joined.

It is a further objective of the present invention to provide such a method in which the overall pattern may be accurately maintained without the danger of inaccurate pieces destroying the integrity of the overall pattern.

It is a further objective of the present invention to provide such a method which may be readily understood and practiced by craftspersons who desire to make patchwork articles and which uses conventional and readily available instruments and material.

It is a still further objective of the present invention to provide such a method in which the individual craftspersons may themselves determine the overall design of the patchwork article and need not utilize designs previously published and yet will be assured that the patchwork pieces will fit together in an accurate manner to form the desired overall design.

It is a feature of the present invention to provide a method of making patchwork articles from pieces of textile fabric, including such natural fabrics as cotton, silk and wool as well as artificial fabrics such as nylon, polyester and rayon. As with conventional patchwork articles, the patchwork article may be made from otherwise discardable cloth or used clothing or other fabric.

The first step in the method of the present invention is for the craftsperson to draw the overall design on a piece of paper using a fine point pen or other fine point marking device to form visible lines on the paper. The paper is not a stiff cardboard but rather is a flexible paper such as semi-transparent draftsman's paper. Each of the closed geometric shapes, such as triangles, squares and hexagons, which make up the overall pattern, are then numbered or otherwise marked in an orderly sequence, for example, using both numbers and letters. The overall design on the paper corresponds exactly to the final overall design on the patchwork article and does not take account of borders on each piece to be cut.

The next step is for the craftsperson to cut out individual paper patterns from the paper. Each of the paper patterns will consequently be a closed geometric figure having a marked indicia indicating its final position in the pattern. Next the craftsperson pins each of the cut paper patterns to a suitable piece of textile fabric and cuts out the fabric, allowing $\frac{3}{8}$ to $\frac{1}{2}$ of an inch all around each of the paper patterns for a border. In other words, each of the paper patterns is used as an individual templet. The fabric which is cut out is then joined to the paper by which it was cut, using temporary stitching (basting). After a suitable number of individual patchwork pieces have been thus formed, they are joined together, for example, using hand sewing. The location of each patchwork piece is given by the indicia, i.e., the letter and number placed on the back of the paper pattern. Each fabric piece is joined so that its individual paper pattern, when viewed from the back of the article, would have the same shape, size and relative location as in the original overall pattern as drawn on the paper. After a suitably sized square of the article is sewn together, the temporary stitches and the paper patterns are removed. The overall pattern of the patchwork fabric article corresponds to the overall pattern as drawn on the paper as the relative locations are maintained using the letters and numbers on the backs of the paper patterns.

BRIEF DESCRIPTION OF THE DRAWINGS

Other objectives and features of the present invention will be apparent from the following detailed description of the invention which provides the inventor's best presently known mode of executing the invention, which detailed description should be taken in conjunction with the accompanying drawings.

In the drawings.

DETAILED DESCRIPTION OF THE INVENTION

Figure 1:
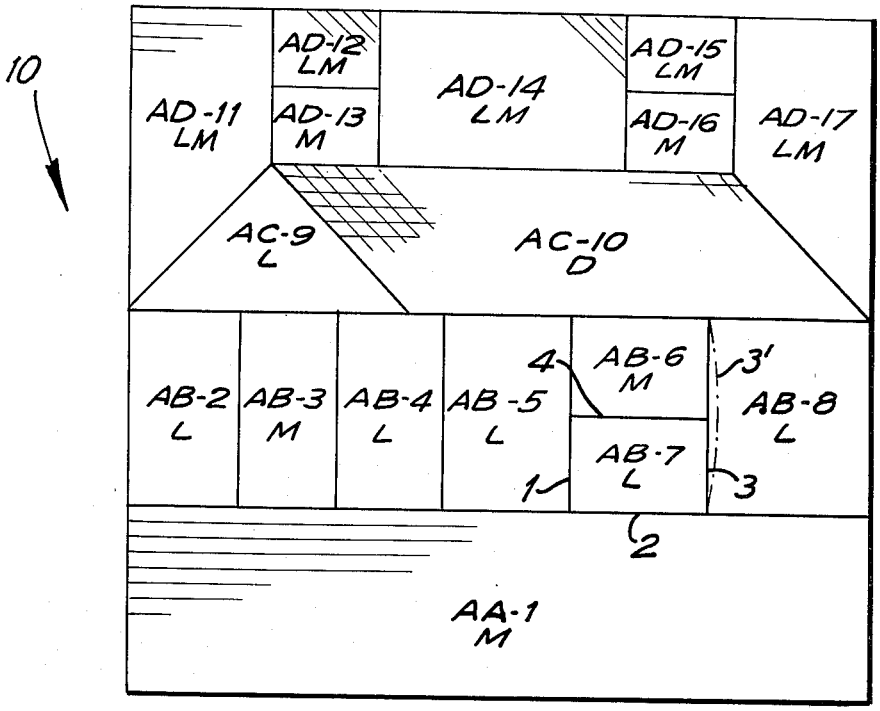
FIG. 1 is a top plan view of a portion of the overall pattern drawn on a sheet of suitable flexible paper in accordance with the method of the present invention.

The first step, in accordance with the method of the present invention, is for the user to decide upon the overall pattern that is going to be utilized to make the patchwork article. This overall pattern is formed on a master drawing, preferably using graph paper and drafting tools, i.e., a ruler, compass, etc. The master drawing is then copied, for example, by pen tracing onto flexible tracing paper. Preferably, the copy paper is semi-transparent draftsman's paper, which allows the back of the patterns on the fabric to be seen. The overall pattern may be copied from pattern sheets, from a book or may be an original drawing. As shown in FIG. 1, patterns copied onto tracing paper may comprise a series of rectangles and triangles, each being a closed geometric shape. The rectangles and triangles are nestled in rows so that the shapes of each row have common edges with the next row. For example, as shown in FIG. 1, the rectangle AB-7 has common edges 1, 2, 3 and 4 with respectively the rectangles AB-5, AA-1, AB-8 and AB-6. The overall pattern may utilize any closed geometric shapes such as squares, rectangles, triangles, hexagons and other polygons, circles, ellipses, ect., and combinations of such shapes.

Each closed geometric shape of the pattern 10 is then appropriately labeled by the user with visible indicia, for example, using a pen, in an orderly way. For example, the block is labeled with a letter, the rows are labeled in order with letters and each geometric shape numbered in consecutive order. If desired, the indicia (except for the block indication) may be entered on the master drawing which is reproduced. Each reproduction of the master drawing may have a different block number or letter. For example, the rectangle "AB-7-L" means it is block A, row B, number 7, and light in color. The other color indications are M (medium, D (dark) and LM (light-medium). Although the letter and number system is preferred, other systems may also be used, for example, pairs of letters such as A-CC or pairs of numbers such as 14–10, or other numerical or alphanumerical systems. It is important, however, that a system be applied in which the individual geometric shapes, after being separated from each other, can be rejoined in the original order as the overall pattern 10 as drawn on the paper.

The overall pattern 10 may be an original pattern or may be based on a pattern found in a book. In either case it is required, in accordance with the present invention, that the entire overall pattern be applied to flexible paper. If the pattern is a simple geometric shape such as the interlocking shapes of FIG. 1 and there are many such interlocking figures, an easy method is to duplicate the pattern on suitable duplicating means, such as a Xerox (TM of Xerox Corp.) machine. The overall pattern may be a block, for example 12 inches×12 inches, of the patchwork article, such as a quilt, or may be the overall pattern for the entire article, such as a pillow or a chair cover.

Figure 2:
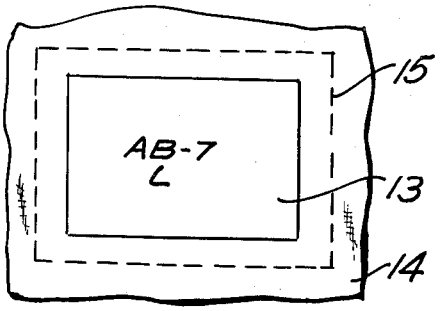
FIG. 2 is an enlarged back plan view of an individual paper pattern as it is applied to a piece of textile fabric and used as a guide to cut the fabric.

The next step is for the user to cut along the lines of the overall pattern 10 of each block to form individual paper patterns. As shown in FIG. 2, an individual paper pattern 13, labeled A-7 for purposes of illustration, is laid on a larger piece of fabric material 14. The user may temporarily join the paper pattern to the fabric material 14, using a straight pin. The user will then cut the fabric piece along the imaginary dotted line 15, which is a line parallel to the exterior of the paper pattern 13. The material between the exterior edges of the paper pattern 13 and the line 15 forms the border.

In the next step of the process the fabric material, which has been cut as shown in FIG. 2 to form the fabric piece 16, is folded so that its borders overlie the back side of the paper pattern 13. The paper and fabric piece may be temporarily joined by a pin. The back side of the paper pattern 13 is the side having the indicia 17, that is, it is the front face of the overall pattern 10, as shown in FIG. 1. The folded-over borders of the fabric piece 16 are then joined to the paper pattern 13 by temporary threads 18. The user, after having followed the procedure with each of the paper patterns cut from the overall pattern 10, now has a large number of individual fabric pieces, each of which is joined by temporary threads to a corresponding numbered paper pattern.

The next step is to join the individual fabric pieces in the same arrangement as the paper patterns were in the original overall pattern 10. As in conventional patchwork methods, the edges of the proximate fabric pieces are joined, for example, by sewing by hand, with the sewing preferably being as close as possible to the joined edges.

Figure 4:
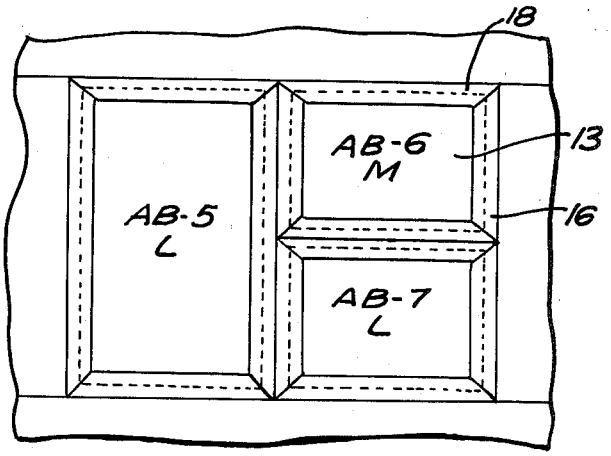
FIG. 4 is a back plan view of a portion of the patchwork article after the pieces have been assembled by sewing, or otherwise, and before the temporary stitching is removed and the papers taken out from the individual pieces.
Figure 3:
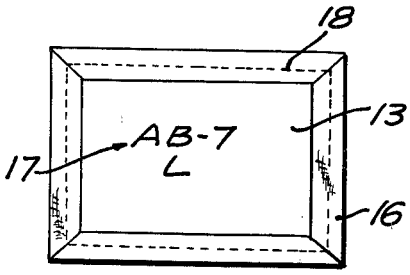
FIG. 3 is an enlarged back plan view of an individual paper pattern and a fabric piece cut-out utilizing that pattern and connected to the paper pattern by temporary stitching.

As shown in FIG. 4, which shows the back side of a portion of the finished patchwork article, each of the shaped fabric pieces has been joined to its proximate fabric piece. The arrangement of the paper patterns, as given by the alphanumerical ordered system, is followed so that the paper patterns are arranged as on the overall pattern of FIG. 1. The next step is to remove the temporary stitching 18 from the patchwork article and remove the flexible paper patterns from the patchwork article.

The method of the present invention provides an accurate method of transferring the overall pattern drawn on paper to the final patchwork article. In the event there have been slight errors made on the line between the geometric shapes of the overall pattern, such errors need not result in an appearance which would detract from the patchwork article. For example, if a mistake was made on lines 2 and 3 so that they are not quite even or quite straight, the mistake may be compensated for by the fact that the indentations of the adjacent rectangles would not show when the edges are sewed together. For example, if line 3' is curved, as shown in FIG. 1, there would still be an apparent match between the rectangles AB-6, AB-7 with rectangle AB-8 in that the slight bulge from line 3' in the rectangles AB-6, AB-7 would be compensated for by the inward curvature of the same line 3' in the rectangle AB-8. In contrast, if a similar error were made in the templets of the conventional methods of patchwork, there would not be any compensation since each of the fabric pieces is treated as if it were a uniform piece without taking account of the actual geometric shape, as cut, to which it is joined.

The method of the present invention reduces the chance of a cumulative type of error. For example, using conventional methods, a small error using one templet, which may occur in cutting, may accumulate over a large pattern and ruin the appearance of the article.

As patchwork articles are hand-sewn and may require a large expenditure of time and effort, those errors which affect the appearance of the article may prove highly frustrating to the craftsperson. The present method permits inspection to see if the pieces fit, and adjustment to make them fit, before they are sewn, thereby reducing the likelihood of such errors.

What is claimed is:

1. The method of making patchwork articles from pieces of textile fabric, including the steps in the named sequence of:

(a) forming an overall design in visible lines on flexible paper, the visible lines forming a large plurality of closed geometric shapes whose borders are common, the said overall design corresponding in shape, size and design to the final patchwork article, (b) marking visible indicia of location in the overall pattern on each of said closed shapes, (c) cutting along the lines to form a plurality of individual paper patterns each being a closed shape, (d) using each of the said paper patterns to cut one fabric piece, each piece having a border which extends entirely around and beyond the paper pattern from which it was cut, folding the borders of said fabric piece over the edges of said paper pattern, and joining each fabric piece by temporary stitches to the paper pattern from which it was cut, (e) joining the fabric pieces based upon the indicia on the paper patterns to duplicate in the patchwork article the pattern of the original overall pattern, and (f) removing the temporary stitches and paper patches from the fabric pieces.

2. The method of claim 1 wherein the overall design is formed by multiple duplication of a design drawn on paper.

3. The method of claim 1 wherein the paper patterns and the fabric pieces are temporarily secured by pins prior to cutting the fabric.

* * * * *